United States Patent [19]

Wieczorek

[11] Patent Number: 4,793,983

[45] Date of Patent: Dec. 27, 1988

[54] METHOD OF REPROCESSING BORON CARBIDE IRRADIATED WITH NEUTRONS FROM TRIM OR SHUT-DOWN ELEMENTS FROM NUCLEAR REACTORS

[75] Inventor: Herbert Wieczorek, Weingarten, Fed. Rep. of Germany

[73] Assignee: Kernforschungszentrum Karlsruhe GmbH, Karlsruhe, Fed. Rep. of Germany

[21] Appl. No.: 116,861

[22] Filed: Nov. 4, 1987

[30] Foreign Application Priority Data

Dec. 16, 1986 [DE] Fed. Rep. of Germany ..... 3642841

[51] Int. Cl.[4] ..... E01B 31/36

[52] U.S. Cl. ..... 423/291; 423/2; 252/626

[58] Field of Search ..... 423/291, 289, 439, 2, 423/4, 18, 20; 252/626, 627, 630, 631, 632

[56] References Cited

U.S. PATENT DOCUMENTS

| | | | |
|---|---|---|---|
| 2,553,444 | 5/1951 | Dunn et al. | 423/291 |
| 4,434,092 | 2/1984 | Mary | 252/627 |

FOREIGN PATENT DOCUMENTS

| | | | |
|---|---|---|---|
| 59-30710 | 2/1984 | Japan | 423/291 |
| 898403 | 6/1962 | United Kingdom | 423/291 |
| 1023292 | 3/1966 | United Kingdom | 423/291 |

*Primary Examiner*—John Doll
*Assistant Examiner*—R. Bruce Breneman
*Attorney, Agent, or Firm*—Spencer & Frank

[57] ABSTRACT

A method of reprocessing neutron-irradiated contaminated boron carbide, including the steps of:

dissolving the contaminated boron carbide in a mixture of sulfuric and nitric acids at an elevated temperature, to convert the boron carbide to boric acid, and to form an exhaust gas of nitric oxide and carbon dioxide;

introducing water or tritiated, boric acid-containing water in liquid form under the surface of the hot acid mixture of the dissolving step, to produce steam;

steam distilling the boric acid developed in the dissolving step with the aid of the steam generated in the introducing step, to separate the boric acid from nonvolatile radioactive and nonradioactive corrosion and irradiation products;

condensing the boric acid-containing steam from the steam distilling s tep to yield boric acid and a condensate containing water or $^3H$-containing water;

evaporating the condensate from the condensing step to dry and calcine the boric acid to form boron oxide and water vapor of $^3H$-containing water vapor;

recycling, in liquid form, the water vapor or $^3H$-containing vapor formed in the evaporating step, after condensation, into the water in the introducing step or the mixture of acids in the dissolving step;

forming nitric acid by recycling at least part of the first exhaust gas developed in the dissolving step by adding air and water, and producing another exhaust gas containing carbon dioxide; and converting the boron oxide obtained in the evaporating step to boron carbide.

6 Claims, 1 Drawing Sheet

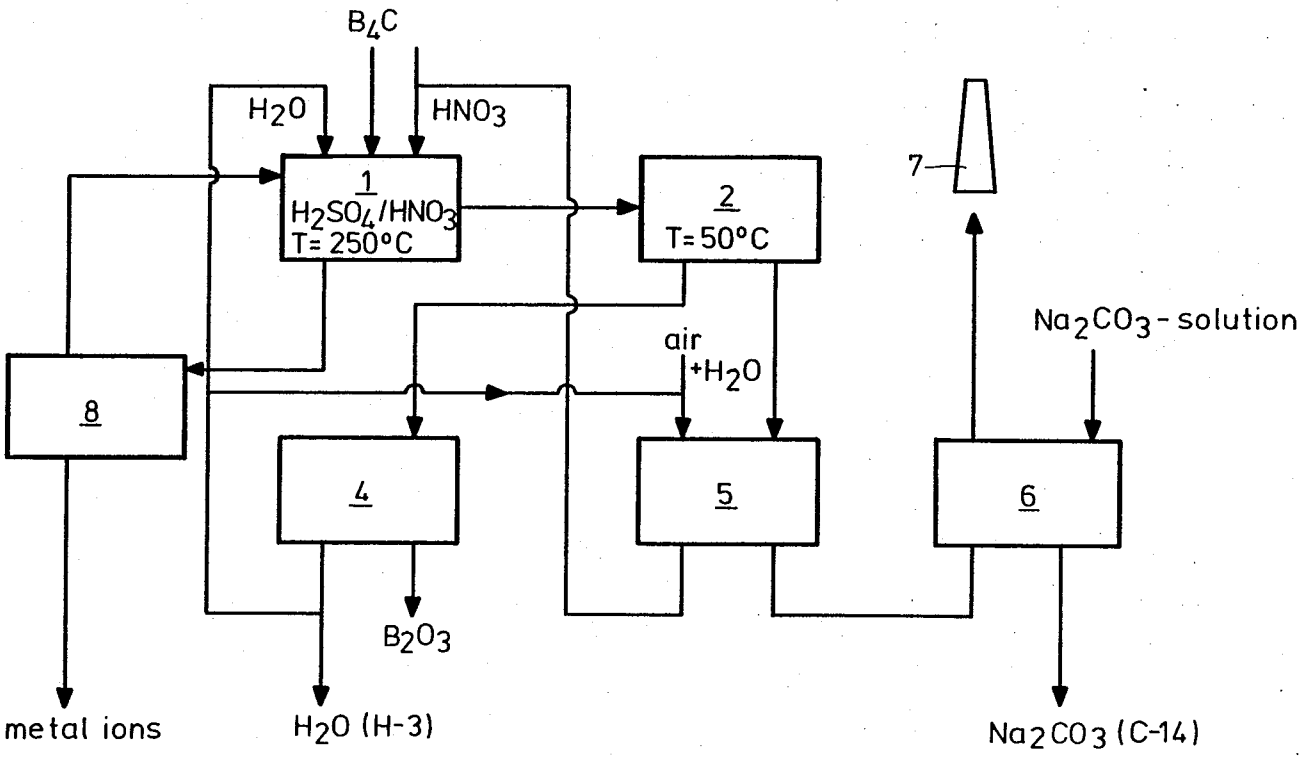
$B_4C$
$H_2O$
$HNO_3$
1
$H_2SO_4/HNO_3$
T=250°C
2
T=50°C
air
$+H_2O$
5
4
$B_2O_3$
$H_2O$ (H-3)
8
metal ions
7
$Na_2CO_3$-solution
6
$Na_2CO_3$ (C-14)

METHOD OF REPROCESSING BORON CARBIDE IRRADIATED WITH NEUTRONS FROM TRIM OR SHUT-DOWN ELEMENTS FROM NUCLEAR REACTORS

BACKGROUND OF THE INVENTION

The present invention relates to a method of reprocessing neutron irradiated corrosion products, irradiation products and other contaminants containing boron carbide ($B_4C$) from trim or shut-down elements of nuclear reactors in which the boron carbide, freed from its metal cladding and comminuted, is brought into contact with a hot mixture of sulfuric acid and nitric acid.

To control the neutron flux in breeder reactors, $^{10}B$ boron carbide is employed in the control trim and shut-down elements in the appropriate arrangement. For example, the fast breeder reactor SNR 300 in Kalkar, Federal Republic of Germany is equipped with 9 control trim elements and 3 shut-down elements together employing approximately 100 kg $^{10}B$ boron carbide. Both of these types of elements are used until the $^{10}B$ isotopic enrichment reaches 75% (the initial $^{10}B$ isotopic enrichment is about 90%). The discharged absorber rods thus still contain considerable quantities of $^{10}B$. Since $^{10}B$ is expensive and its availability is limited, the problem of reprocessing it arises.

If $^{10}B$ boron carbide is irradiated with neutrons (conditions in the nuclear reactor) tritium ($^3H$) is formed in addition to lithium. The following contaminants of boron carbide are produced: $^{54}Mn$, $^{55}Fe$, $^{58}Co$ and $^{60}Co$ as well as $^{14}C$. Except for the lithium, all other products are radioactive.

SUMMARY OF THE INVENTION

It is an object of the present invention to provide a method of reprocessing neutron irradiated boron carbide from trim or shut-down elements of nuclear reactors in which the boron carbide can be obtained in pure form from the irradiated elements and can be reused for the production of such elements without having to undergo additional purification processes. The amount of waste developed in the implementation of the process is kept as small as possible and the contamination of the environment with radioactive substances, as, for example, $^{14}C$ or $^3H$, is excluded.

This is accomplished according to the invention by the combination of the followigg process steps:

(a) dissolving the $B_4C$ in a mixture of hot sulfuric and nitric acids, thus causing the $B_4C$ to be converted to boric acid and $CO_2$, and exhaust gases containing nitric oxide to be formed in the reaction solution;

(b) introducing water or tritiated, boric acid-containing water in liquid form under the surface of the hot reaction solution of step (a);

(c) expelling the boric acid developed in step (a) by steam distillation with the aid of the water vapor or vapor of the tritiated, boric acid-containing water generated in step (b) from the reaction solution;

(d) condensing the boric-acid containing vapor;

(e) evaporating the condensate from step (d) to dry and calcine the boric acid to form $B_2O_3$;

(f) recycling, in liquid form, the $H_2O$ or $^3H$- containing $H_2O$ vapor formed in step (e), after condensation, into the water in step (b) or into the reaction solution in step (a);

(g) recycling at least part of the nitric oxide and $CO_2$-containing exhaust gas developed in step (a) which remains in the vapor chamber during the condensation of the boric acid-containing vapor (step (d)), with the addition of air and $H_2O$ in liquid form as nitric acid either into additional sulfuric acid or directly into the acid mixture (step (a));

(h) converting the $B_2O_3$ obtained in step (e) to $B_4C$.

An advantageous embodiment of the process according to the invention is characterized in that part of the $H_2O$ or $^3H$-containing $H_2O$ vapor formed in step (e) is utilized, in liquid form, after condensation, for the absorption of the nitric oxides in the exhaust gas treated in step (g).

The remainder of the exhaust gas developed in step (a) is washed in an alkali washer before it is discharged to the environment, thus absorbing the $CO_2$. Advantageously, the radioactive and nonradioactive corrosion and irradiation products present in the reaction solution in an undissolved form or precipitated therefrom due to the solubility product being exceeded are separated from a recyclable partial stream of the reaction solution.

Since the production of boron carbide is effected by reducing boron oxide with carbon, the product of a dissolution process for $B_4C$ should be boron oxide. Such boron oxide should not contain any contaminants and, due to the danger of tritium being carried along, should be free of water. Six basic operations are used to implement the process according to the invention:

dissolving $B_4C$ at 200° to 250° C. in sulfuric acid with the aid of nitric acid and simultaneous expulsion, of the boric acid produced, from the dissolver by steam distillation;

condensation of the vapor and separation of the precipitated boric acid;

oxidation of the NO and absorption of the resulting $NO_x$ to form nitric acid;

alkali washing of the carbon dioxide;

calcination of the boric acid to form boron oxide;

conversion of the boron oxide to boron carbide.

BRIEF DESCRIPTION OF THE DRAWING

The sole figure provided is a schematic illustration of the process according to the invention.

DESCRIPTION OF THE PREFERRED EMBODIMENTS

Inactive Example (without radioactive contaminants)

800 g (14.4 Mol) boron carbide in 5 liters $H_2SO_4$ (96 weight %) were filled into a reactor 1 equipped with a stirring device. The reactor contents were heated and, when a temperature of 250° C. had been reached, 80 ml/h nitric acid (55 weight %) and 30 l/h water were added underneath the surface of the acid. After a reaction time of 15 hours, 396 g (7.15 Mol) boron carbide had been dissolved. All of the generated boric acid was located in condenser 2. It was separated from the condensate by filtration and fed into a calciner 4 in which the boric acid was calcined to boron oxide. Calciner 4 is connected with reactor 1 in such a manner that the resulting $^3H$-containing water vapor, or at least most of it, can be returned to the reactor. After oxidation with air and absorption of the nitric oxides by the water in a reaction vessel or a mixing path 5, the condensate from condenser 2 was fed into reactor 1. The remaining exhaust gas was conducted through a washer 6 charged with an aqueous $Na_2CO_3$ solution and then discharged into a chimney 7. The highly acid solution was transferred from reactor 1 into a filter vessel 8 for the separation of the corrosion and irradiation products and, after the separation, was recycled into reactor 1.

Example for the distribution of radioactivity (calculated):

| (Reference: SNR 300 = 111.1 kg $B_4C$, 400 days of full load, 1 year cooling time): tritium ($^3H$) 48.2 $10^{13}$ Bq; $\epsilon\beta$ = 20 keV contaminants: 10.36 $10^{10}$ Bq; of the following composition: | |
|---|---|
| $^{54}Mn$ (54%) | $5.59 \cdot 10^{10}$ Bq |
| $^{55}Fe$ (29%) | $3.00 \cdot 10^{10}$ Bq |
| $^{58}Co$ (6%) | $0.62 \cdot 10^{10}$ Bq |
| $^{60}Co$ (6%) | $0.62 \cdot 10^{10}$ Bq |
| $^{14}C$ (5%) | $0.53 \cdot 10^{10}$ Bq $\epsilon\beta$ = 20 keV |
| quantities: | tritium ($^3H$) = 1.34 g |
| | $^{14}C$ = 6.7 mg |
| where $\epsilon\beta$ is the energy of the observable beta emission. | |

The present disclosure relates to the subject matter disclosed in German No. P 36 42 841.8 of Dec. 16th, 1986, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A method of reprocessing neutron-irradiated contaminated boron carbide, containing corrosion products, irradiation products and other contaminants comprising the steps of:

(a) dissolving the contaminated boron carbide in a hot acid mixture comprising sulfuric and nitric acids at a temperature sufficiently high, to convert boron carbide to boric acid, and to form a first exhaust gas comprising nitric oxide and carbon dioxide;

(b) introducing at least one of water and tritiated, boric acid-containing water in liquid form under the surface of the hot acid mixture of said dissolving step, to produce steam;

(c) steam distilling the boric acid developed in said dissolving step wihh the aid of the steam generated in said introducing step, to separate the boric acid from nonvolatile radioactive and nonradioactive corrosion and irradiation products;

(d) condensing the boric acid-containing steam from said steam distilling step to provide boric acid and a condensate comprising at least one of water and $^3H$-containing water;

(e) evaporating the condensate from said condensing step to dry and calcine the boric acid to form boron oxide and at least one of water vapor and $^3H$-containing water vapor;

(f) recycling, in liquid form, the water vapor or $^3H$-containing vapor formed in said evaporating step, after condensation, into one of the water in said introducing step and the hot acid mixture in said dissolving step;

(g) forming nitric acid by recycling at least part of the first exhaust gas developed in said dissolving step by adding air and water, and producing a second exhaust gas comprising carbon dioxide; and (h) converting the boron oxide obtained in said evaporating step to boron carbide.

2. Process as defined in claim 1, comprising the additional step of using at least part of the one of water vapor and $^3H$-containing water vapor formed in the evaporating step, in liquid form after condensation, for producing the nitric acid in the forming step.

3. Process as defined in claim 1, comprising the additional step of washing the second exhaust gas produced in said forming step in an alkali washer before discharge to the environment, to absorb the carbon dioxide.

4. Process as defined in claim 1, comprising the additional step of removing the nonvolatile radioactive and nonradioactive corrosion and irradiation products separated from the boric acid in said steam distiling step, from a recyclable partial stream of the mixture of sulfuric and nitric acids.

5. Process as defined in claim 1, comprising the additional step of adding the nitric acid produced in said forming step to the mixture of sulfuric and nitric acids used in the dissolving step.

6. Process as defined in claim 1, comprising the additional step of adding the nitric acid produced in said forming step to a supply of sulfuric acid to generate a mixture of sulfuric acid and nitric acids.

* * * * *